US007146648B1

(12) United States Patent
Kessee

(10) Patent No.: US 7,146,648 B1
(45) Date of Patent: Dec. 12, 2006

(54) NOVELTY IMPLEMENTS FOR PROVIDING USER ENJOYMENT

(76) Inventor: Ralph L. Kessee, 3477 Floresta Ave., Los Angeles, CA (US) 90043

( * ) Notice: Subject to any disclaimer, the term of this patent is extended or adjusted under 35 U.S.C. 154(b) by 0 days.

(21) Appl. No.: 11/045,422

(22) Filed: Jan. 31, 2005

(51) Int. Cl.
*A41D 19/00* (2006.01)

(52) U.S. Cl. ..... 2/160; 446/26; 446/220

(58) Field of Classification Search ..... 2/160, 2/DIG. 3, 16, 20; 446/26, 220
See application file for complete search history.

(56) References Cited

U.S. PATENT DOCUMENTS

| | | | | |
|---|---|---|---|---|
| 1,066,696 | A * | 7/1913 | Baker | 441/58 |
| 1,455,826 | A * | 5/1923 | Yorgnesen | 441/58 |
| 2,282,056 | A | 5/1942 | Hoeflich | |
| 4,455,963 | A * | 6/1984 | Matsuo | 116/306 |
| 4,486,975 | A * | 12/1984 | Harreld et al. | 446/220 |
| 5,025,502 | A | 6/1991 | Raymond et al. | |
| D339,380 | S | 9/1993 | Scapillato | |
| 5,603,118 | A | 2/1997 | Solomon | |
| 6,108,817 | A | 8/2000 | Kostelac | |
| 6,308,331 | B1 * | 10/2001 | Robak | 2/19 |
| 6,612,056 | B1 * | 9/2003 | Thomas, II | 40/586 |

OTHER PUBLICATIONS

Title of Source: www.threadedimages.com Product Name: No. 1 Inflatable Hand.

* cited by examiner

*Primary Examiner*—Katherine M. Moran

(57) ABSTRACT

Hand-operable implements include a plurality of inflatable gloves that are sized and shaped for protruding beyond a user's metacarpals. The gloves are formed from air-impermeable material, have rear sides including a plurality of auxiliary support bands attached thereto, and have substantially smooth and planar front surfaces such that when a user engages the gloves during operating conditions, an elevated acoustic sound is generated therefrom. Each auxiliary support band extends upwardly and away from the rear sides of the gloves. The implements further include a mechanism for allowing a user to selectively inflate the gloves to a desired pressure level such that the user may enjoy use of the gloves during recreational activities as well as fold and store the gloves during non-operating conditions.

10 Claims, 2 Drawing Sheets

NOVELTY IMPLEMENTS FOR PROVIDING USER ENJOYMENT

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to implements for user enjoyment and, more particularly, to novelty implements for providing user enjoyment and for promoting recreational activities associated with cheering.

2. Prior Art

In past years, a variety of promotional novelties have been used such as pins, hats, shirts, helmets, banners and the like. These novelties generally depicted the supported individual or team or supportive expressions and may be decorated with a suitable logo or slogan and team colors. In recent years, spectators' interest in promoting individuals or teams has grown considerably. Today, auditoriums, sports arenas and stadiums are built to accommodate larger numbers of spectators. Also, expanded television coverage of spectator events now reaches millions of home viewing spectators.

Today, because the vast majority of spectators are physically isolated and unable to express their support, verbally, among themselves or with the individuals or team members they support, or with home viewing spectators, various forms of non-verbal means of communication have evolved. In recent years, efforts have been made to promote novelty items to allow the spectator to better communicate, visually as well as verbally, his or her support and enthusiasm at various events.

One such novelty device is a polymeric foam device of construction outlining the image of an oversized hand which has an index finger raised in an upright fashion and the balance of the fingers clinched in a fist formation. The spectator utilizes this promotional novelty device by displaying it in a prominent location or by raising it over his head and waving it, to symbolize that his team is "No. 1". However, such devices are passive devices and do not adequately express the spectator's active enthusiasm. The foam construction of these devices is inadequate for striking two such devices together for generating a supportive noise for their team.

Accordingly, a need remains for a novelty implement for providing user enjoyment in order to overcome the above-noted shortcomings. The present invention satisfies such a need by providing a novelty implement that is safe and easy to use, lightweight, portable, convenient, and novel in design. Such an implement provides sports fans with a fun and inventive novelty item for use at sporting events. A pair of these inflatable hands can be struck together in unison with musical rallies or other fans to show support of their home team, or derision of opposing teams. The inflatable design allows for easy storage of the implement during non-operating conditions, and also prevents pain in the hands due to excessive clapping and cheering.

BRIEF SUMMARY OF THE INVENTION

In view of the foregoing background, it is therefore an object of the present invention to provide novelty implements for providing user enjoyment. These and other objects, features, and advantages of the invention are provided by a pair of hand-operable implements for promoting recreational activities associated with cheering, clapping and the like.

The hand-operable implements include a plurality of inflatable gloves removably positionable against a user's hands respectively. Each glove is sized and shaped for protruding beyond a user's metacarpals and terminates at a predetermined distance outwardly and away therefrom such that the gloves simulate grossly enlarged hands respectively. Such gloves are formed from air-impermeable material that has a sufficient rigidity such that when the user repeatedly manipulates the gloves in a back-and-forth motion, the gloves advantageously maintain a generally uniform and stable shape.

Each glove has a rear side including a plurality of auxiliary support bands attached thereto and selectively spaced therealong for conveniently receiving the user's metacarpals therebetween. Each such glove has a substantially smooth and planar front surface such that when a user engages the gloves during operating conditions, an elevated acoustic sound is generated therefrom. Each auxiliary support band has a generally symmetrical shape and extends upwardly and away from the rear sides of the gloves respectively. Such auxiliary bands may be formed from elastic material for effectively maintaining sufficient surface area contact about the user's metacarpals during operating conditions.

Each glove preferably further includes a primary support band attached to the rear side such that the user may removably position a proximal wrist portion therethrough while simultaneously positioning their metacarpals through the auxiliary support bands. Furthermore, each glove is preferably maintained at a fixed spatial relationship with the user's metacarpals such that as a user's hands are pivoted from a vertical axis, the gloves are caused to also pivot along the vertical axis and extend substantially parallel to the user's metacarpals.

The present invention further includes a mechanism for allowing a user to selectively inflate the gloves to a desired pressure level such that the user may readily enjoy use of the gloves during recreational activities, as well as fold and store the gloves during non-operating conditions. Such an inflating mechanism may include an air valve operably secured to a proximal end portion of each glove that is adaptable between open and closed positions such that the use may readily inject a volume of air into the gloves.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
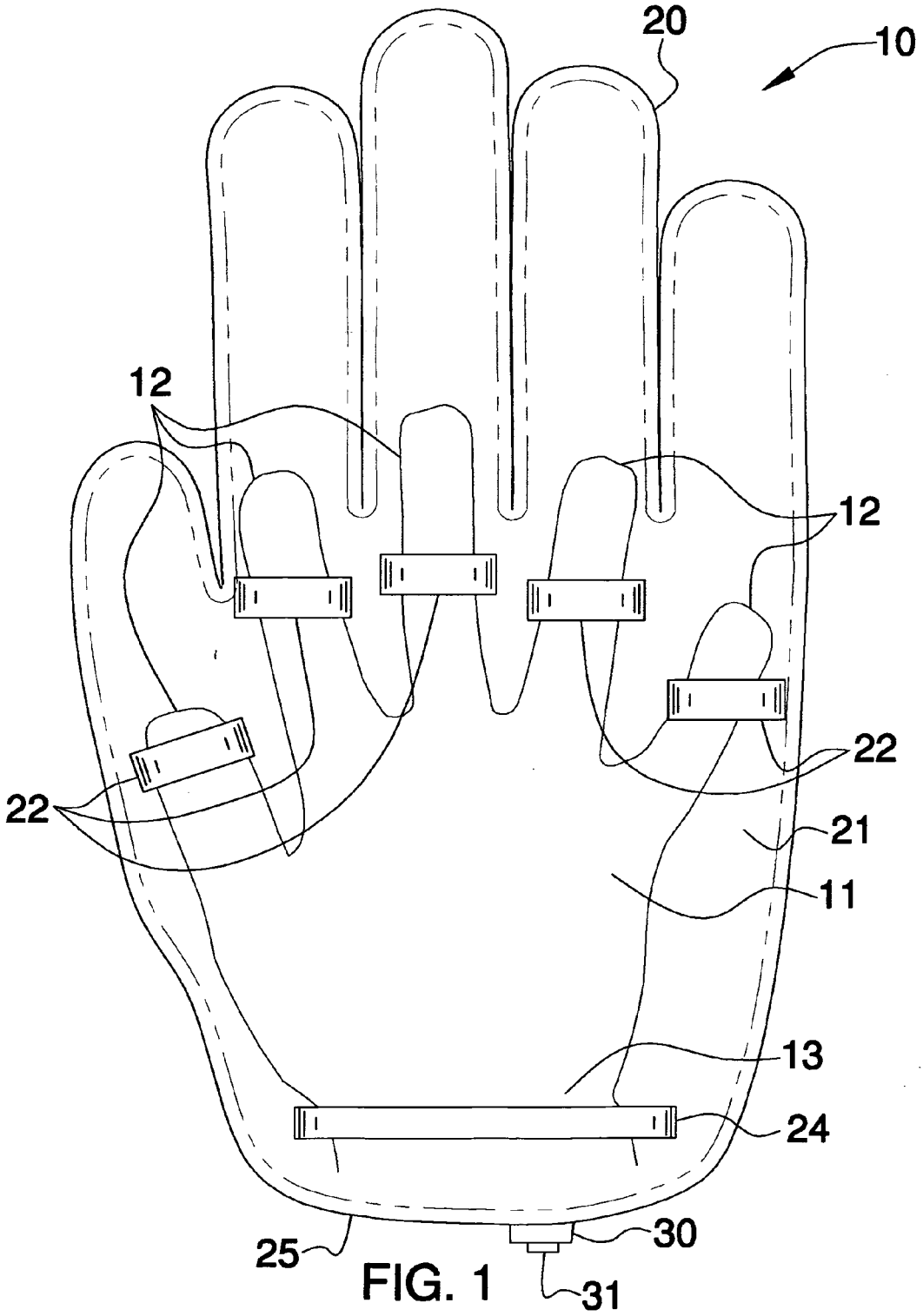
FIG. 1 is a top plan view showing a novelty implement for providing user enjoyment, in accordance with the present invention.
Figure 2:
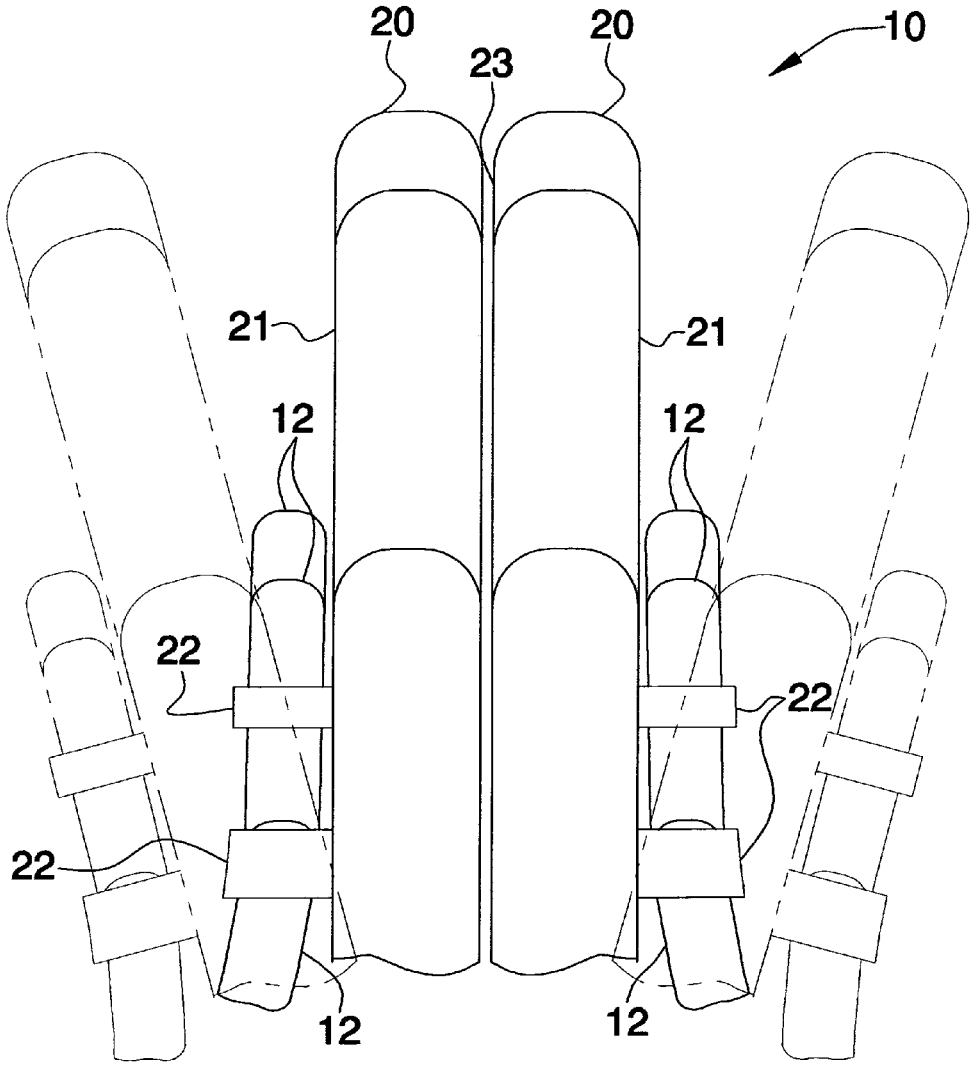
FIG. 2 is a side elevational view of the implement shown in FIG. 1.

The implements of this invention are referred to generally in FIGS. 1–2 by the reference numeral 10 and are intended to protect novelty implements for providing user enjoyment. It should be understood that the implements 10 may be used to show support in many different types of settings and should not be limited in use to only sporting events.

Referring initially to FIGS. 1 and 2, the implements 10 include a plurality of inflatable gloves 20 removably positionable against a user's hands 11 respectively. Each glove 20 is sized and shaped for protruding beyond a user's metacarpals 12 and terminates at a predetermined distance outwardly and away therefrom such that the gloves 20 simulate grossly enlarged hands respectively. Such gloves 20 are formed from air-impermeable material that has a sufficient rigidity such that when the user repeatedly manipulates the gloves in a back-and-forth motion, the gloves advantageously maintain a generally uniform and stable shape, thus allowing for the extended use thereof as is often needed during sporting events.

Still referring to FIGS. 1 and 2, each glove 20 has a rear side 21 including a plurality of auxiliary support bands 22 attached thereto and selectively spaced therealong for conveniently receiving the user's metacarpals 12 therebetween. Each such glove 20 has a substantially smooth and planar front surface 23 such that when a user engages the gloves 20 during operating conditions, an elevated acoustic sound is generated therefrom for advantageously showing the user's support or derision of a team, respectively. Of course, the front 23 and rear 21 sides of the gloves 20 may further be provided with surface indicia (not shown) that shows their support of a particular team, as is well known to a person of ordinary skill in the industry.

Each auxiliary support band 22 has a generally symmetrical shape and extends upwardly and away from the rear sides 21 of the gloves 20 respectively. Such auxiliary bands 22 are formed from elastic material for effectively maintaining sufficient surface area contact about the user's metacarpals 12 during operating conditions. Of course, the auxiliary bands 22 may be produced from alternate materials, such as Velcro straps, as is obvious to an individual of ordinary skill in the art. Such auxiliary bands 22 advantageously ensure that the gloves 20 remain engaged with the user's metacarpals 12 during the back and forth motion experienced from clapping and other cheering gestures.

Referring to FIG. 1, each glove 20 further includes a primary support band 24 attached to the rear side 21 such that the user may removably position a proximal wrist portion 13 therethrough while simultaneously positioning their metacarpals 12 through the auxiliary support bands 22, thus completely engaging the user's hand 11 with the glove 20. Furthermore, each glove 20 is maintained at a fixed spatial relationship with the user's metacarpals 12 such that as a user's hands 11 are pivoted from a vertical axis, the gloves 20 are caused to also pivot along the vertical axis and extend substantially parallel to the user's metacarpals 12.

Referring to FIG. 1, the present invention further includes a mechanism 30 for allowing a user to selectively inflate the gloves 20 to a desired pressure level such that the user may readily enjoy use of the gloves 20 during recreational activities as well as fold and store the gloves 20 during non-operating conditions. Such an inflating mechanism 30 includes an air valve 31 operably secured to a proximal end portion 25 of each glove 20 that is adaptable between open and closed positions such that the user may readily inject a volume of air into the gloves 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A pair of hand-operable implements for promoting recreational activities associated with cheering, clapping and the like, said hand-operable implements comprising:

a plurality of inflatable gloves removably positionable against a users hands respectively, each said glove being sized and shaped for protruding beyond a user's metacarpals and terminating at a predetermined distance outwardly and away therefrom such that said gloves simulate grossly enlarged hands respectively, said gloves being formed from air-impermeable material having a sufficient rigidity such that when the user repeatedly manipulates said gloves in a back-and-forth motion said gloves maintain a generally uniform and stable shape, each said glove having a rear side including a plurality of auxiliary support bands attached thereto and selectively spaced therealong for receiving the user's metacarpals therebetween; and means for allowing a user to selectively inflate said gloves to a desired pressure level such that the user may readily enjoy use of said gloves during recreational activities as well as fold and store said gloves during non operating conditions.

2. The hand-operable implements of claim 1, wherein each said glove further includes a primary support band attached to said rear side such that the user may removably position a proximal wrist portion therethrough while simultaneously positioning their metacarpals through said auxiliary support bands.

3. The hand-operable implements of claim 1, wherein said inflating means comprises:

an air valve operably secured to a proximal end portion of each said glove and being adaptable between open and closed positions such that the use may readily inject a volume of air into said gloves.

4. The hand-operable implements of claim 1, wherein said auxiliary bands are formed from elastic material for effectively maintaining sufficient surface area contact about the user's metacarpals during operating conditions.

5. The hand-operable implements of claim 1, wherein each said glove is maintained at a fixed spatial relationship with the user's metacarpals such that as a user's hands are pivoted from a vertical axis said gloves are caused to also pivot along the vertical axis and extend substantially parallel to the user's metacarpals.

6. A pair of hand-operable implements for promoting recreational activities associated with cheering, clapping and the like, said hand-operable implements comprising:

a plurality of inflatable gloves removably positionable against a users hands respectively, each said glove being sized and shaped for protruding beyond a user's metacarpals and terminating at a predetermined distance outwardly and away therefrom such that said gloves simulate grossly enlarged hands respectively, said gloves being formed from air-impermeable material having a sufficient rigidity such that when the user repeatedly manipulates said gloves in a back-and-forth motion said gloves maintain a generally uniform and stable shape, each said glove having a rear side including a plurality of auxiliary support bands attached thereto and selectively spaced therealong for receiving the user's metacarpals therebetween, wherein each said glove has a substantially smooth and planar front surface such that when a user engages said gloves during operating conditions an elevated acoustic sound is generated therefrom; and means for allowing a user to selectively inflate said gloves to a desired pressure level such that the user may readily enjoy use of said gloves during recreational activities as well as fold and store said gloves during non operating conditions.

7. The hand-operable implements of claim 6, wherein each said glove further includes a primary support band attached to said rear side such that the user may removably position a proximal wrist portion therethrough while simultaneously positioning their metacarpals through said auxiliary support bands.

8. The hand-operable implements of claim 6, wherein said inflating means comprises:

an air valve operably secured to a proximal end portion of each said glove and being adaptable between open and closed positions such that the use may readily inject a volume of air into said gloves.

9. The hand-operable implements of claim 6, wherein said auxiliary bands are formed from elastic material for effectively maintaining sufficient surface area contact about the user's metacarpals during operating conditions.

10. The hand-operable implements of claim 6, wherein each said glove is maintained at a fixed spatial relationship with the user's metacarpals such that as a user's hands are pivoted from a vertical axis said gloves are caused to also pivot along the vertical axis and extend substantially parallel to the user's metacarpals.

* * * * *